US005767840A

United States Patent [19]

Selker

[11] Patent Number: 5,767,840

[45] Date of Patent: Jun. 16, 1998

[54] SIX-DEGREES-OF-FREEDOM MOVEMENT SENSOR HAVING STRAIN GAUGE MECHANICAL SUPPORTS

[75] Inventor: Edwin Joseph Selker, Palo Alto, Calif.

[73] Assignee: International Business Machines Corporation, Armonk, N.Y.

[21] Appl. No.: 672,738

[22] Filed: Jun. 28, 1996

[51] Int. Cl.[6] ..... G05G 9/047

[52] U.S. Cl. ..... 345/161; 73/862.041; 73/862.042; 73/862.043; 73/862.044; 73/862.045; 74/471 XY; 338/2; 338/5; 338/6; 414/2

[58] Field of Search ..... 345/161; 128/782; 74/471 XY, 469; 338/2, 5, 6; 73/862.041, 862.042, 862.043, 862.044, 862.045; 414/2

[56] References Cited

U.S. PATENT DOCUMENTS

| | | | |
|---|---|---|---|
| Re. 29,765 | 9/1978 | Crane et al. | 73/862.044 |
| 4,348,142 | 9/1982 | Figour | 414/2 |
| 4,589,810 | 5/1986 | Heindl et al. | 414/5 |
| 4,641,123 | 2/1987 | Whitehead | 74/471 XY |
| 4,736,640 | 4/1988 | Hooks | 73/866.1 |
| 4,738,417 | 4/1988 | Wenger | 74/471 XY |
| 4,747,313 | 5/1988 | Okada | 73/862.043 |
| 4,876,524 | 10/1989 | Jenkins | 338/2 |
| 4,879,556 | 11/1989 | Duimel | 341/20 |
| 4,938,059 | 7/1990 | Faucher et al. | 73/147 |
| 5,129,277 | 7/1992 | Lautzenhiser | 74/471 XY |
| 5,589,828 | 12/1996 | Armstrong | 345/161 X |

*Primary Examiner*—Raymond J. Bayerl
*Assistant Examiner*—Seth D. Vail
*Attorney, Agent, or Firm*—James C. Pintner

[57] ABSTRACT

A user-manipulable sensor apparatus is provided for allowing a user to input, through hand manipulation of a movable member, motion in six degrees of freedom: translational motion in the X, Y, and Z axes, and rotation about each of those three axes. The apparatus includes a central member which acts as a stationary reference, and a user-manipulable member, such as a spherical, hollow member which substantially surrounds the central member. Flexible wire or in-line strain gauges are coupled between the central member and the inside surface of the user-manipulable member, to hold the user-manipulable member in a quiescent position, relative to a position of the central member. Accordingly, there is no need for additional support members for holding the user-manipulable member in position. Manipulation of the user-manipulable member causes tension on various ones of the strain gauges. The strain gauges produce signals, from which the motion of the user-manipulable member may be computed.

4 Claims, 5 Drawing Sheets

SIX-DEGREES-OF-FREEDOM MOVEMENT SENSOR HAVING STRAIN GAUGE MECHANICAL SUPPORTS

FIELD OF THE INVENTION

The invention generally relates to the field of user interfaces for electronic devices such as computers and electronic games. More specifically, the invention relates to user command interfaces for allowing a user to enter commands having magnitude and direction.

BACKGROUND OF THE INVENTION

Since the advent of computerized video games and computer graphical user interfaces (GUI), it has become commonplace for such systems to provide a user input device such as a movable joystick, a mouse, and a pointing device such as IBM's TrackPoint II and III in-keyboard pointing devices.

Joysticks came into use in connection with video games, and were used primarily for horizontal and vertical translational movements, to direct the movement of a video symbol, correspondingly, in the vertical and horizontal directions on the video game screen. An example is the video game "Pac-Man", which was popular during the early 1980s.

(Note that, for the purpose of this discussion, "horizontal" and "vertical" refer to movements within the plane of a two-dimensional display, such as a video screen.)

An example of a joystick apparatus is described in Jenkins, U.S. Pat. No. 4,876,524, "Six-Axis Joystick Control". In this patent, there is described a joystick including a torsion rod having a fixed end and a user-manipulable free end, and having strain gauges disposed on the surface of the rod. As the user manipulates the free end of the rod, the strain gauges produce signals. As described in detail in the text, the Jenkins apparatus allows for detection of motion in all six degrees of freedom.

The graphical user interface became widely used in computer technology also during the 1980s. While earlier systems operated on user commands entered as text strings through a keyboard, the GUI systems have operated based on user movement of a graphical cursor onto iconic representations of files or application programs, and activation of the files or applications by means of push button "clicks." Again, mice primarily serve as input devices for user-directed translational movements in the horizontal and vertical direction.

A more compact alternative to a mouse is found in IBM Corp.'s TrackPoint II and III in-keyboard pointing devices. These devices provide a small fingertip-sized cap, positioned between two adjacent keys in a keyboard. The user presses his/her fingertip against the cap to provide a mechanical strain, which is detected by built-in strain gauges. A magnitude and a horizontal/vertical direction is obtained, based on the user-applied force. The cursor on the screen moves in response to the force, according to a predetermined transfer function. Again, the TrackPoint device is generally used for horizontal/vertical translational movement.

Other mechanical devices have been developed, which enable a user to provide input force that can be measured as any of the three translational and three rotational degrees of freedom. In general, these devices have been relatively complex and, therefore, expensive.

For instance, Okada, U.S. Pat. No. 4,747,313, "Tactile Sensor," describes a device shown in FIGS. 1 and 2, which are reproductions of FIGS. 1(*a*) and 2(*a*), respectively, of the drawings in the Okada patent. The following three paragraphs are a substantially word-for-word transcription of Okada's description of these drawings.

FIG. 1 shows a first embodiment of the tactile sensor according to the invention. FIG. 2 shows the tactile sensor experiencing an externally applied force. Referring to the drawings, a cylindrical sensor body 1 has an end plate 1*a* provided with a composite bearing 4 consisting of an axial slider 4*a* and a spherical bearing 4*b* at the center of the end plate 1*a*. The axial slider 4*a* is supported in the spherical bearing 4*b*. Reference numeral 2 designates a sensitive shell. The sensitive shell 2 has a hemispherical form, and is integral with a support rod 3 extending from the inner surface. The support rod 3 is supported for axial movement and rotation in the composite bearing 4.

The sensitive shell 2, which is supported by the support rod 3, is disposed at a position slightly spaced apart from the end plate 1*a* of the sensor body 1, such that it is tiltable in all directions with respect to the sensor body 1, and is also axially displaceable. A disk 7 is secured to the free end of the support rod 3 projecting from the bearing 4 into the sensor body 1. A plurality of radially uniformly spaced-apart extension springs 6 are connected at one end to the edge of the disk 7, and are coupled at the other end to the inner periphery of the sensor body 1, via respective detection means 9.

In the absence of any external force applied to the sensitive shell 2, a ring-like stopper 8 provided on an intermediate portion of the support rod 3 comes into contact with the bearing 4, and the sensitive shell is biased such that it can balance at a reference position in a reference orientation. The detection means 9 provided on the springs 6 detect the deformation of deforming force of the springs. If a beam with a load cell or strain gauge is applied to the spring as the detection means, the extension force of the spring, i.e., deforming force, can be detected.

Note that the Okada device includes both the strain gauges 6 and the supporting assembly made up of the components 4*a*, 4*b*, 1*a*, and 8.

Another device is described in Heindl et al., U.S. Pat. No. 4,589,810, "Device for Programming Movements of a Robot." The Heindl device has a substantially spherical handgrip member, which is coupled to the remainder of a sensor unit by means of a structure including support posts and spokes.

Hooks, U.S. Pat. No. 4,736,640, "Compact Six-Degree-of-Freedom Motion Detecting Apparatus and Associated Methods" describes an apparatus having a sphere-shaped grip member, a decoupling cube mounted on a support shaft, extending into the grip member, and a mechanical linkage for coupling the grip member to the cube. Motion sensors detect movement of the grip member, relative to the cube.

Figour, U.S. Pat. No. 4,348,142, "Six-Axes Manipulator" discloses another hollow grip member which fits over a support. The grip and the support are coupled by means of a mechanical linkage including bearings, a ring, and rigid and elastic members.

The Okada, Heindl, Hooks, and Figour apparatus have in common the drawback that they require disadvantageously complex and expensive mechanical linkages between a grip member and support/spatial reference member. It would be desirable to provide an essentially similar configuration, having a generally spherical user grip, but not requiring the complex and expensive mechanical linkages taught in the above-discussed conventional apparatus.

SUMMARY OF THE INVENTION

It is therefore an object of the invention to provide a hand-manipulable sensor apparatus, for detecting movement for all of the six degrees of freedom in three dimensions, which is mechanically simpler and less expensive than conventional devices.

To achieve this and other objects, there is provided in accordance with the invention a motion sensor comprising a central member, a user-manipulable member, and a plurality of sensors disposed between the central member and the user-manipulable member.

The sensors are affixed to the user-manipulable member to mechanically bias the user-manipulable member to a quiescent position, relative to a position of the central member. Preferably, the user-manipulable member is hollow, having an exterior gripping surface, an interior surface, and an aperture through which the interior surface is accessible.

Responsive to manipulation of the user-manipulable member by a user, the user-manipulable member is displaced from the quiescent position. The displacement causes tension on some of the sensors, and relaxation on others. The sensors include means for producing a plurality of respective signals related to the tension on the sensors.

Based on the respective signals, calculations may be made to determine a motion of the user-manipulable member by the user, according to three translational and three rotational degrees of freedom.

Preferably, the sensors include electronic strain gauges which produce electrical signals, and electronic circuitry is used, in a fashion which would be clearly understandable by a person skilled in the electronic arts, for producing signals representative of the movement, in the six degrees of freedom, of the user-manipulable member. Any system employing a six-degrees-of-freedom degrees-of-freedom sensor apparatus may thus employ a device according to the invention in the same manner as conventional sensors are now used.

However, because a device according to the invention eliminates the complex mechanical support assemblies for the user-manipulable member that characterize the prior art references discussed above, an apparatus according to the invention provides advantageous cost savings to the user.

DESCRIPTION OF THE PREFERRED EMBODIMENT

Figure 2:
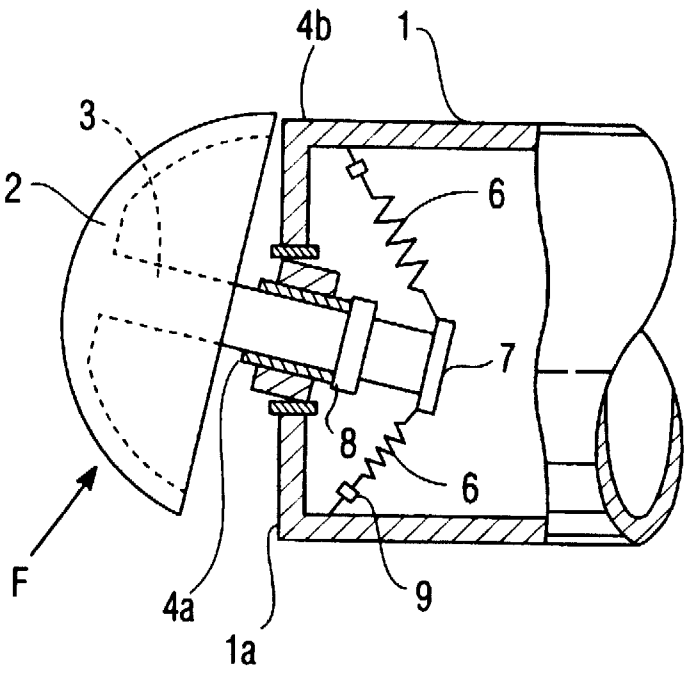
FIGS. 1 and 2 are side views, partly in section, of a prior art motion sensing apparatus.
Figure 1:
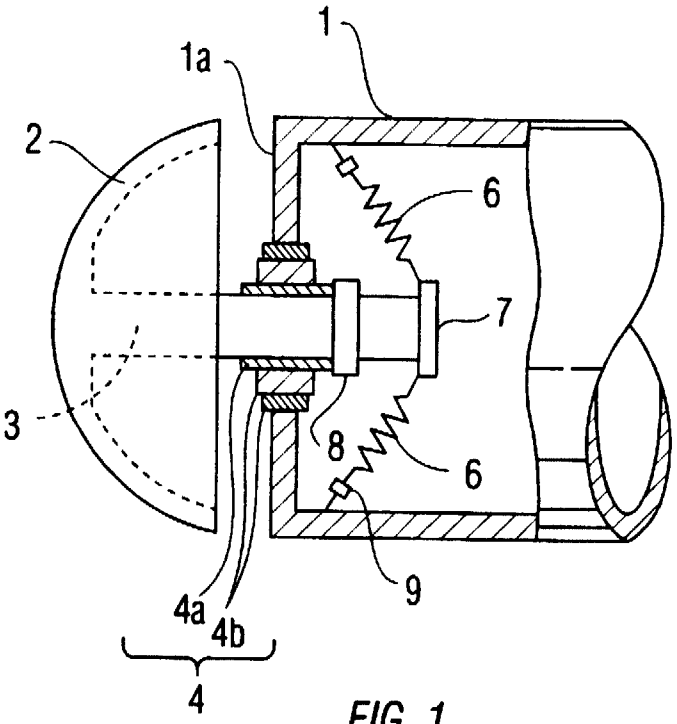
Figure 3:
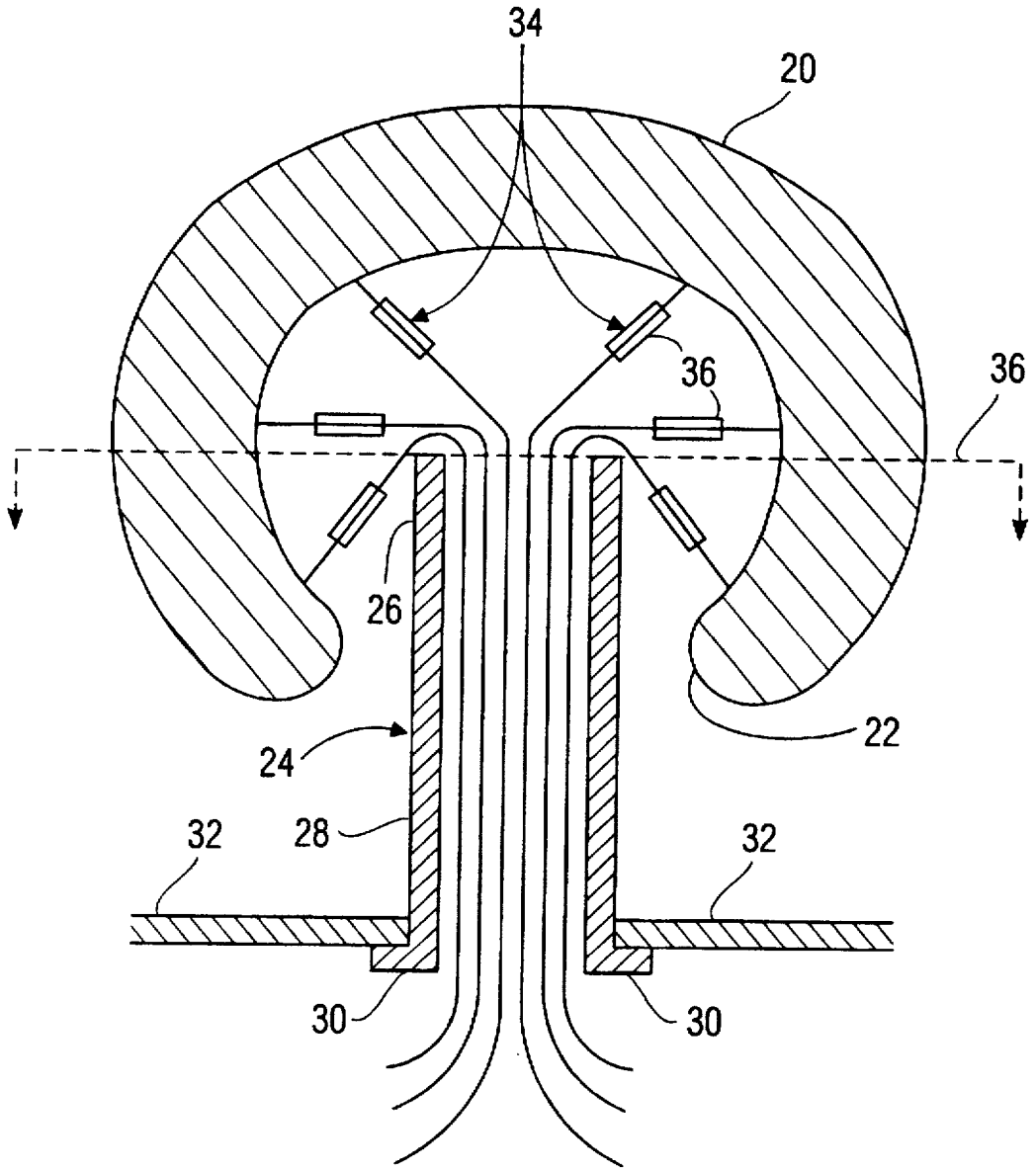
FIG. 3 is a cross-sectional side view of an apparatus according to the invention.
Figure 4:
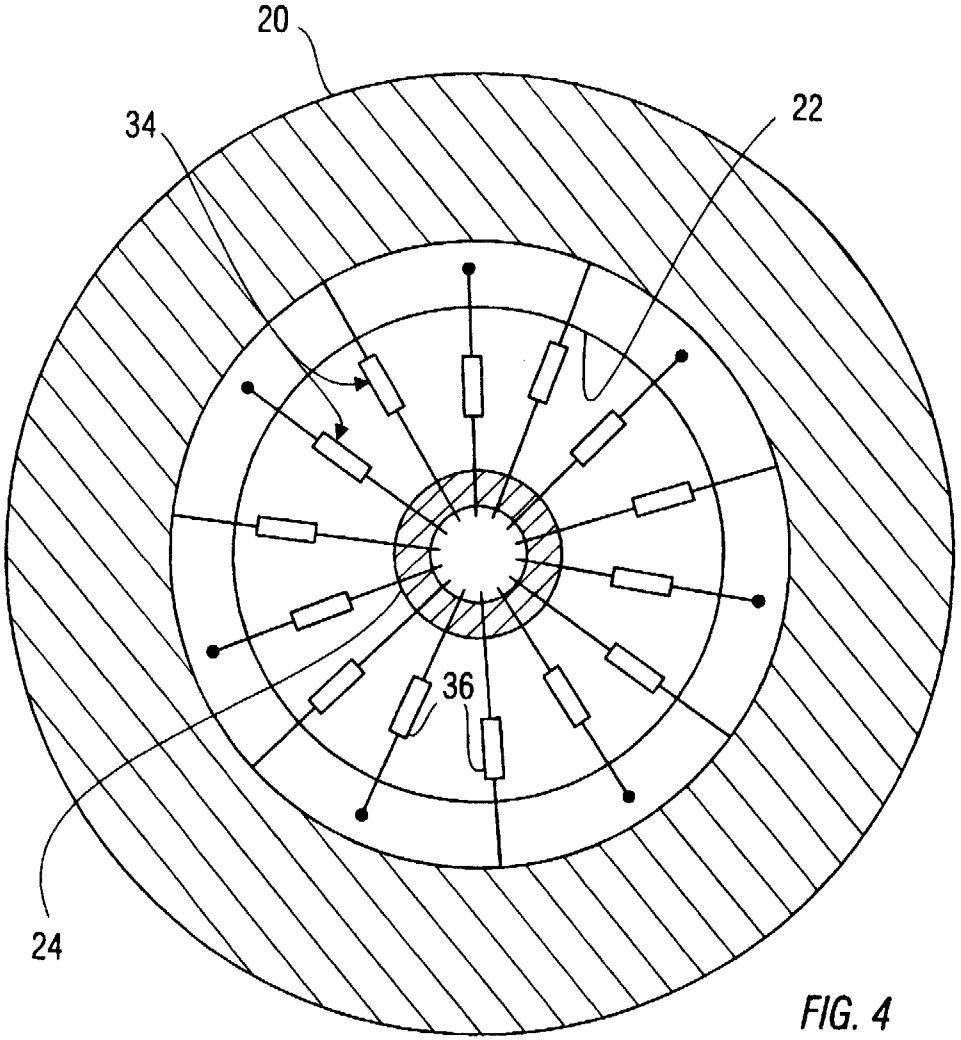
FIG. 4 is a cross-sectional top view of an apparatus according to the invention.

FIGS. 3 and 4 show two cutaway views, a side view and a top view, respectively, of an apparatus according to the invention.

An apparatus according to the invention includes a central member and a user-manipulable member. The user manipulable member has a hollow interior, and is disposed around a portion of the central member. In accordance with the invention, strain gauges for detecting user manipulation of the user-manipulable member are affixed to the interior of the user-manipulable member.

In FIGS. 3 and 4, the user manipulable member is shown as a hollow sphere-shaped grip member 20 having an aperture 22. The central member is shown as a cylindrical tube 24 having an upper end 26 which is inserted into the aperture 22, and having a lower end 28 with a flange 30, for mounting to a substrate or support, such as a circuit board 32.

Motion detectors are coupled to the interior of the user-manipulable member 20. The motion detectors are shown as strain gauges 34, which in the illustrated example are made up of wires and in-line sensing elements 36.

The central member 24 serves two purposes. First, the central member 24 serves as a focal point about which the user-manipulable member 20 is mechanically biased to a quiescent position. This will be described in detail below. Second, the central member serves as a conduit for directing the wires of the strain gauges 34 out of the aperture 22, by way of the interior of the tube 24 of the central member, for coupling to suitable circuitry. Preferably, the substrate 32 includes a circuit board bearing suitable circuit components. The ends of the strain gauges 34 are coupled to this circuitry in a suitable fashion (not shown).

It is a particular advantage of the invention that no support members other than the strain gauges 34 are used for coupling the user-manipulable member 20 to the rest of the apparatus. Thus, mechanical simplicity and low cost are realized.

In accordance with the invention, the strain gauges 34 are coupled at various sites over the interior of the user-manipulable member 20. The strain gauges 34 are taut, between their contact sites on the interior surface of the user-manipulable member 20 and the upper end 26 of the tube 24, down the length of the tube 24, and from the bottom of the tube 24 to their contact points in the circuitry on the circuit board 32.

In accordance with the invention, the fact that the strain gauges 34 are taut causes the user-manipulable member 20 to be held, or mechanically biased, into a position (called a "quiescent" position) in which the tensile forces on the strain gauges 34 are balanced.

To produce a quiescent position in three dimensions, the interior surface contact sites for the strain gauges 34 on the member 20 are distributed in a variety of directions. The upper end 26 of the tube 24 may be thought of as a "focal point" or "origin", from which the strain gauges radiate outward to the interior surface of the member 20.

FIG. 4 is a cutaway top view of the apparatus of FIG. 3, looking downward from a section taken along a plane 37 shown in FIG. 3.

It will be seen from FIG. 4 that the strain gauges 34 radiate upward and downward, and to the left and right, from the top end 26 of the tube 24. Accordingly, any translational movement of the member 20 in any of these directions causes some of the strain gauges to be stretched. Based on which ones are stretched, the nature of the movement can then be calculated in conventional fashion.

FIG. 3 also shows that some of the strain gauges 34 are coupled to the member 20 above the plane 37, and some are coupled below the plane 37. As a consequence, the member 20 is also mechanically biased to the quiescent position in the direction coaxial with the tube 24. Thus, translational motion of the member 20 can be detected for all three dimensions based on the signals produced by the strain gauges 34.

Similarly, rotational motion of the member 20 in any of the three dimensions may be detected, based on the strain gauge signals.

Detection of the direction of the translational or rotational motions may be facilitated through a particular mechanical configuration of the strain gauges, which will now be discussed in connection with FIG. 5.

Figure 5:
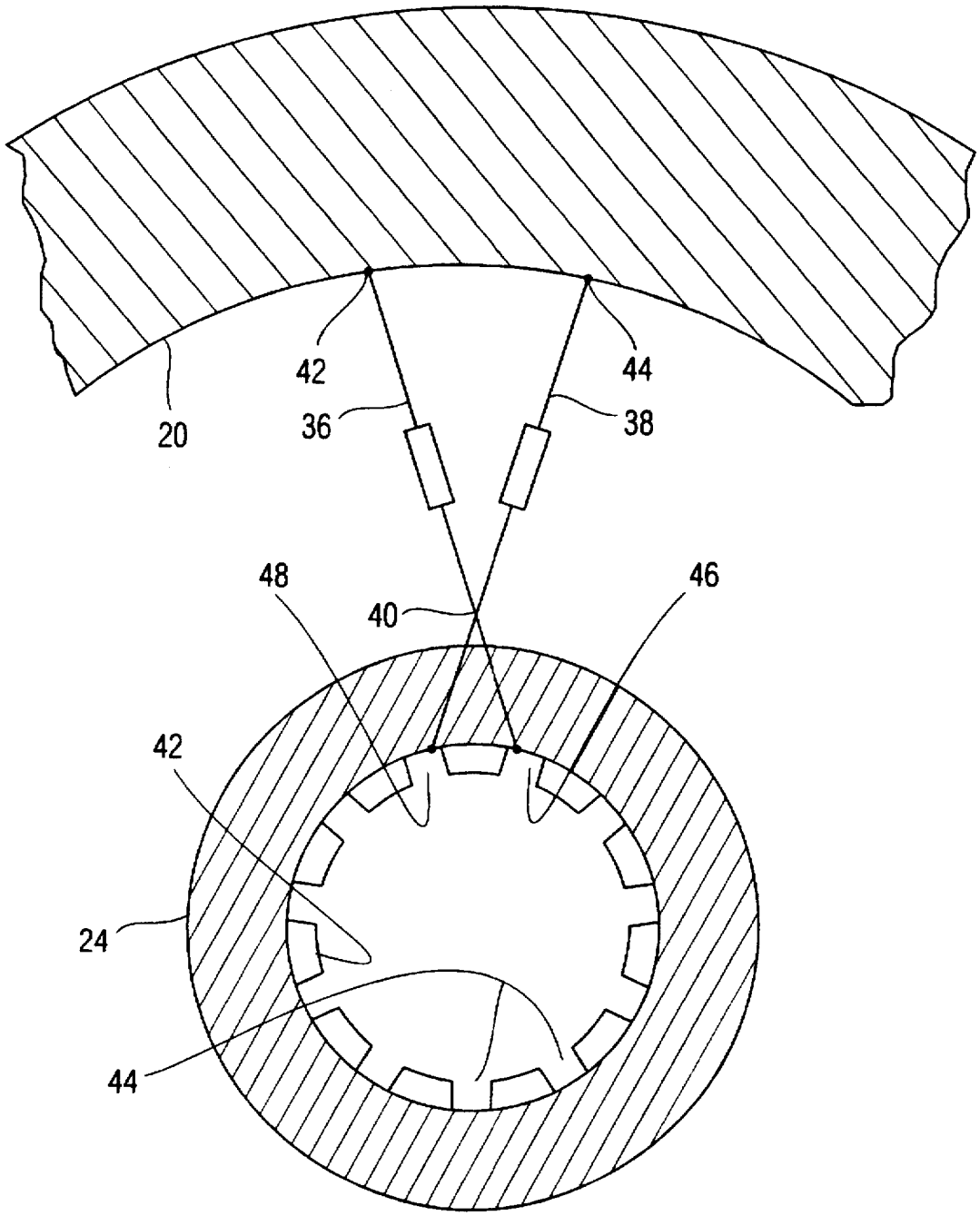
FIG. 5 is a cross-sectional view of a portion of an apparatus according to the invention, similar to the view of FIG. 4, but showing further details of a preferred embodiment thereof.

FIG. 5 is a cutaway top view, similar to that of FIG. 4 but being at a greater level of magnification for convenient illustration of greater detail, and showing only a portion of the user-manipulable member 20. In accordance with the invention, a pair of strain gauges 39 and 41 are shown. As discussed above, the strain gauges 39 and 41 run through the tube 24, emerge at the top 26 of the tube 24, and run outward to the member 20.

However, in accordance with the invention, the strain gauges 39 and 41 cross at a point 40 in between the tube 24 and the member 20. The crossing of the strain gauges 39 and 41 facilitates detection of the direction of movement of the member 20. Consider, for instance, a rotational motion of the member 20 clockwise within the plane of FIG. 5. If the strain gauges 34 were all merely radiating outward from the tube 24, they would all be stretched equally, and the direction of rotation would not be measurable. However, in the illustrated disposition, the strain gauge 41 is stretched, while the strain gauge 39 is relaxed. The opposite would be true for counterclockwise rotation.

The same principle may be applied for translational motion. Accordingly, in accordance with the invention, pairs of crossed strain gauges are disposed at different positions, relative to the inside of the member 20, so that the direction of motion can thusly be determined for all six degrees of freedom.

As shown, the ends of the strain gauges 39 and 41 are affixed to the inside of the member 20 at points 42 and 44, respectively. To further ensure that the strain gauges remain in the crossed position, a ring 43 having inward-facing notches 45 is preferably disposed at the top 26 of the tube 24. The ring 43 includes a sufficient number of notches for all of the strain gauges 34 to be used. The notches 45 are disposed about the inner perimeter of the ring 43, so that the outward tension on each strain gauge (described above) holds the strain gauges in place.

For example, the strain gauges 39 and 41 of FIG. 5 are held by notches 46 and 48, respectively. The notch 46 is clockwise of a notch 48, while the affix point 42 is counterclockwise of the affix point 44. Therefore, the affix points 42 and 44, and the notches 46 and 48, work cooperatively to hold the strain gauges in the crossed configuration.

It might be noteworthy that this principle of crossed lines is also used in the arrangement of spokes in bicycle tires. There, however, the primary purpose of the configuration is to increase the mechanical efficiency of transfer of energy from the rotation of the axle, responsive to the rider pedaling the bicycle, to the rim of the tire to cause the bicycle to move.

Given the above-discussed objectives of the disposition of the strain gauges, for detecting magnitude and direction of movement in all three translational and all three rotational degrees of freedom and also for biasing the user-manipulable member to a quiescent position, there will now be given consideration of the minimum number of strain gauges, and their configuration, which achieve both of these objectives.

Subject to the above criteria of biasing the position of the member 20 and providing for detection of magnitude and direction of all six degrees of freedom, the number of strain gauges 34, and the positions of their contact sites on the interior surface of the member 20 may vary, within the spirit and scope of the invention. For illustrative purposes in FIGS. 3 and 4, a large number of strain gauges have been shown, but this many need not be used.

Figure 6:
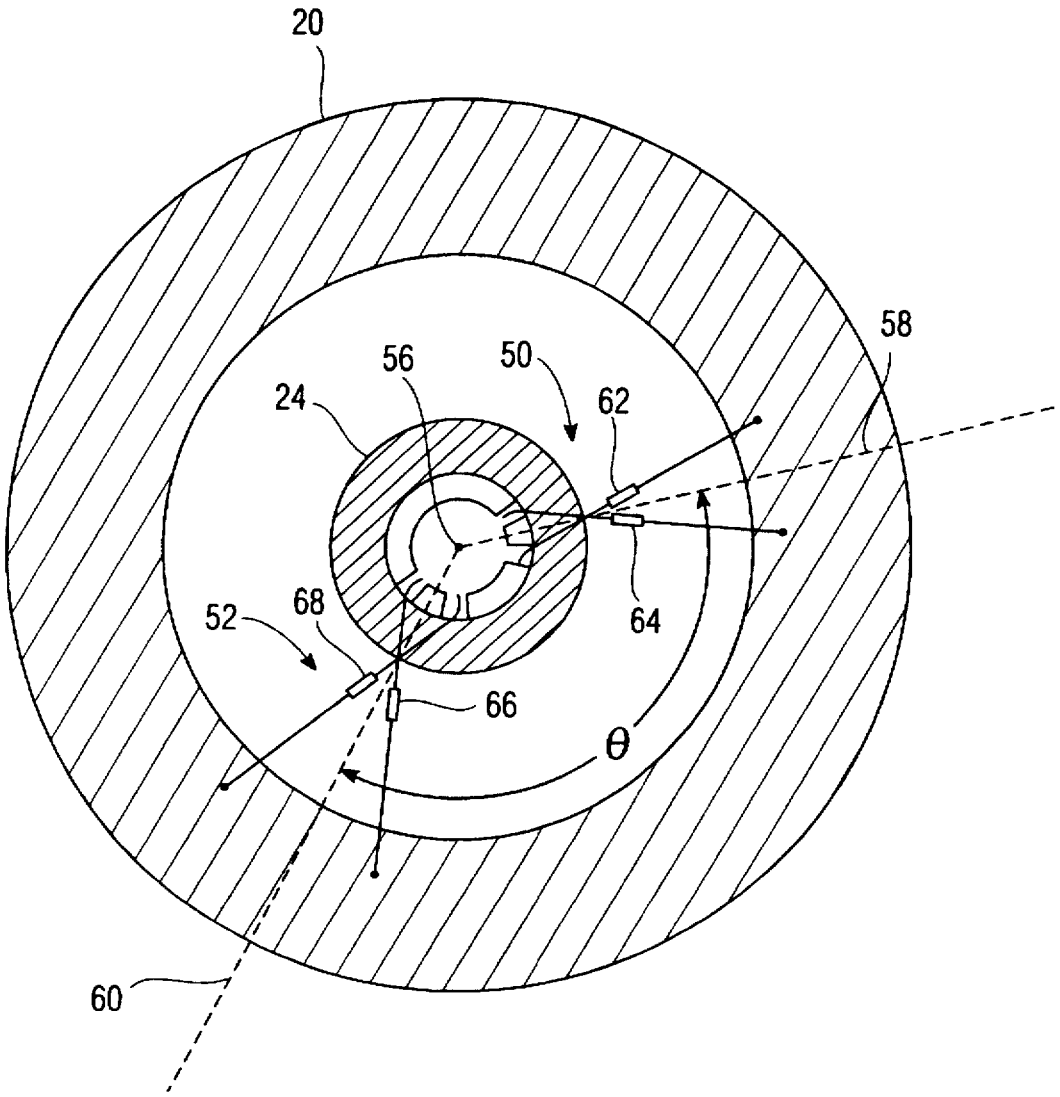
FIG. 6 is a cross-sectional view of a portion of an apparatus according to the invention, similar to the view of FIG. 4, but showing further details of a preferred embodiment thereof.

FIG. 6 is another cutaway top view, which further illustrates a principle of the invention, which is useful in determining how few strain gauges are necessary to calculate the required magnitudes and directions of the six degrees of freedom. FIG. 6 will be described primarily in terms of horizontal and vertical translation within the plane of the drawing, and rotation about the axis of the tube 24. However, the principles shown in these examples may be applied to three dimensions, and to the remaining degrees of freedom, in the same fashion as will be discussed here.

In FIG. 6, two pairs of strain gauges are designated collectively as 50 and 52. The pairs 50 and 52 may be essentially coplanar, within the plane of the drawing, as shown, and include crossed strain gauges as discussed with reference to FIG. 5. Alternatively, the affix points on the interior of the member 20 may be displaced directly above or below the plane of the drawing, for the purpose of biasing the position of the member 20 as discussed above. In this latter case, a projection of the displaced strain gauges into the plane of the drawing would still give them the crossed configuration, as shown.

From a point 56 on the axis of the tube 24. Two imaginary lines 58 and 60 radiate outward. These imaginary lines may be thought of as axes of the respective pairs 50 and 52 of strain gauges. The lines 58 and 60 are an angle θ apart.

Let us first consider translation to the right. Both strain gauges 62 and 64 of the pair 50 would be stretched, and would produce signals accordingly. A strain gauge 66 of the pair 52 would be stretched slightly, and a strain gauge 68 of the pair 52 would be relaxed slightly.

If the translation is instead to the left, the strain gauges 62 and 64 would be relaxed, and the strain gauges 66 and 68 would respectively be relaxed and stretched slightly.

Thus, translational motion in the horizontal degree of freedom would be detected based on (i) the fact that, in either case the stretching from the pair 52 differ and are slight, and (ii) the fact that the signals from the pair 50 match. The direction is determined by the magnitude of the signals from the pair 50: great stretching indicates rightward translation, and relaxation indicates leftward translation.

If the two lines 58 and 60 are perpendicular to each other, and are oriented horizontally and vertically, then upward or downward translation is detected the same way, except that the signals from the pairs of strain gauges are reversed.

The pairs 58 and 60 are preferably disposed such that the lines 58 and 60 are perpendicular, or close to perpendicular. If they are not, and/or if the translation is not parallel to either of the lines 58 or 60, then linear combinations of vectors, and trigonometry, may be used in a manner well-known in the field of mechanics, to determine the exact nature of the translation.

If there is clockwise rotation about the axis of the tube 24, the strain gauges 64 and 68 are stretched, and the strain gauges 62 and 66 are relaxed. For counterclockwise rotation, the opposite is the case. In general, rotation is evidenced by differences in the signals of a pair of strain gauges, and similar stretching or relaxing in similarly situated strain gauges of different pairs, for example, the strain gauges 62 and 66 of the pairs 50 and 52.

If additional pairs of crossed strain gauges are disposed above and below the plane of FIG. 6, it is possible to detect bidirectional motion in all six degrees of freedom, by considering different pairs of strain gauges.

Depending on the configuration of the members 20 and 24, it is possible to cover all six degrees of freedom with three pairs of strain gauges. However, if the number of strain gauges is increased, then their respective signals lessen the computational burden of applying vector analysis and trigonometry to determine an exact motion which may have both translational and rotational components, and components in directions not aligned with the axes of the strain gauge pairs.

For instance, in the plane of FIG. 6, it would be possible to add a third pair of strain gauges, and dispose the three pairs approximately 120° apart for effective detection of motion in the degrees of freedom described above. Also, taking into consideration all three dimensions, a first pair of strain gauges could be directed substantially straight upward, and two other pairs off sideways in different directions, as shown in FIG. 6. Another possible three-dimensional configuration is one pair upward and three pairs outward and slightly downward, so that the points of intersection between the four imaginary axes of the pairs and the member 20 would be the vertices of a tetrahedron.

Suitable strain gauges, or equivalent motion sensors, which have flexible, tensile elongations for use in a configuration equivalent to that shown in FIGS. 3–6, are well-known. For instance, an alloy of 50% iron and 50% tin, available under the commercial name "Constantan", has properties well suited for use in strain gauges/motion sensors. In the drawings, the strain gauges are shown schematically as wires having in-line rectangles representative of strain gauge components. However, the wires themselves, if made of a suitable material such as "Constantan", may serve as strain gauges.

Piezoelectric strain gauges may also be used, if suitable allowance is made for an overall lengthening of the strain gauge due to a sufficiently large displacement, say, of the order of several millimeters or more.

Also, if the strain gauges are of a type which generates an electrical voltage or other signal as a response to tension, an electrically grounded surface may be provided on the interior of the member 20, to provide a common reference voltage, to which the ends of all of the strain gauges are attached. Suitable insulation on the strain gauges is preferably provided, particular for the portions that would be in contact with the tube 24 of the top ring member 42, and for where the strain gauges of a pair cross each other.

Finally, while the member 20 is shown as being substantially spherical, it may have other physical configurations. For instance, the member 20 may be a tube having a diameter greater than that of the tube 24. In this instance, the quiescent position of the tubular member 20 would preferably be coaxial with the tube 24. Of course, the tube 24 can also have other configurations that would suggest themselves to a skilled artisan.

Also, the notched ring 42 may be replaced with a structurally equivalent member, such as a perforated disk similar to the top of a salt shaker. The strain gauges would then be threaded through the perforations. Other equivalent components would also be known to skilled artisans. The ring 42, the "salt shaker top" member, or other equivalent member may more broadly be described as a "holding member", having holders (i.e., the notches, the perforations, etc.) for holding the strain gauges in the crossed positions.

While the preferred embodiments of the present invention have been illustrated in detail, it should be apparent that modifications and adaptations to those embodiments may occur to one skilled in the art without departing from the scope of the present invention as set forth in the following claims.

What is claimed is:

1. A motion sensor comprising:

a central member;

a user-manipulable member; and a plurality of sensors disposed between the central member and the user-manipulable member, the sensors being affixed to the user-manipulable member to mechanically bias the user-manipulable member to a quiescent position, relative to a position of the central member, the sensors including means, responsive to manipulation of the user-manipulable member by a user, the manipulation displacing the user-manipulable member from the quiescent position and causing tension on the sensors, for producing a plurality of respective signals related to the tension on the sensors;

the user-manipulable member including a generally hollow member having an interior surface which substantially surrounds the central member, and having an exterior surface for physical contact with a user's hand, the sensors being affixed to the interior surface of the user-manipulable member;

whereby, from the respective signals, calculations may be made to determine a motion of the user-manipulable member by the user according to three translational and three rotational degrees of freedom.

2. A motion sensor comprising:

a central member;

a user-manipulable member; and a plurality of sensors disposed between the central member and the user-manipulable member, the sensors being affixed to the user-manipulable member to mechanically bias the user-manipulable member to a quiescent position, relative to a position of the central member, the sensors including means, responsive to manipulation of the user-manipulable member by a user, the manipulation displacing the user-manipulable member from the quiescent position and causing tension on the sensors, for producing a plurality of respective signals related to the tension on the sensors;

the sensors including a first pair of sensors, the sensors of the pair being disposed to cross each other, and coaxially along a first axis;

whereby, from the respective signals, calculations may be made to determine a motion of the user-manipulable member by the user according to three translational and three rotational degrees of freedom.

3. A motion sensor as recited in claim 2, wherein the sensors further include a second pair of sensors, the sensors of the second pair being disposed to cross each other, and coaxially along a second axis, the first and second axes being a predetermined angle apart, such that magnitudes and directions of translational and rotational motion of the user-manipulable member are detectable in terms of:

(i) differences and similarities between motion signals produced by the two sensors of a given one of the pairs, (ii) magnitudes of motion signals of the sensors of one of the pairs, relative to those of the other pair, and (iii) differences and similarities between motion signals produced by respectively corresponding sensors of the first and second pairs.

4. A motion sensor comprising a central member;

a user-manipulable member;

a plurality of sensors disposed between the central member and the user-manipulable member, the sensors being affixed to the user-manipulable member to mechanically bias the user-manipulable member to a quiescent position, relative to a position of the central member, the sensors including means, responsive to manipulation of the user-manipulable member by a user, the manipulation displacing the user-manipulable member from the quiescent position and causing tension on the sensors, for producing a plurality of respective signals related to the tension on the sensors; and a holding member, disposed on the central member, having holders for holding respective ones of the sensors in respective positions, each one of the sensors being stretched between its respective holder of the holding member and the position on the user-manipulable member to which the sensor is affixed, the respective holders for sensors of a pair being positioned to hold the sensors of the pair such that the sensors of the pair cross each other;

whereby, from the respective signals, calculations may be made to determine a motion of the user-manipulable member by the user according to three translational and three rotational degrees of freedom.

* * * * *